US006301551B1

(12) United States Patent
Piscalko et al.

(10) Patent No.: US 6,301,551 B1
(45) Date of Patent: Oct. 9, 2001

(54) REMOTE PILE DRIVING ANALYZER

(75) Inventors: George Piscalko, Rock Creek, OH (US); Carl-John Grävare, Vallda (SE); Frank Rausche, Chagrin Falls, OH (US)

(73) Assignee: Pile Dynamics, Inc., Cleveland, OH (US)

( * ) Notice: Subject to any disclaimer, the term of this patent is extended or adjusted under 35 U.S.C. 154(b) by 0 days.

(21) Appl. No.: 09/164,746

(22) Filed: Oct. 1, 1998

(51) Int. Cl.[7] ..... E02D 13/00

(52) U.S. Cl. ..... 702/188; 340/853.8; 340/853.9; 340/854.1

(58) Field of Search ..... 702/188, 158, 702/166, 182; 340/853.2, 853.3, 853.8, 853.9, 854.1

(56) References Cited

U.S. PATENT DOCUMENTS 4,365,306 * 12/1982 House et al. ..... 364/551
5,303,162 * 4/1994 Yoon ..... 364/550
5,373,346 * 12/1994 Hocker ..... 364/550
5,493,494 * 2/1996 Henderson ..... 364/424.07
5,548,397 * 8/1996 Kool et al. ..... 356/141.01
5,610,818 * 3/1997 Ackroyd et al. ..... 364/424.07
5,845,230 * 12/1998 Lamberson ..... 702/56
5,952,561 * 9/1999 Jaselskis et al. ..... 73/866
5,978,749 * 11/1999 Likins, Jr. et al. ..... 702/158
6,021,198 * 2/2000 Anigbogu et al. ..... 380/9
6,041,582 * 3/2000 Tiede et al. ..... 56/10.2 A
6,101,445 * 8/2000 Albarado et al. ..... 702/9

* cited by examiner

*Primary Examiner*—Patrick Assouad
(74) *Attorney, Agent, or Firm*—Arter & Hadden LLP

(57) ABSTRACT

A pile driving analyzer (PDA) which obtains, processes and stores pile driving data. The PDA is operable as an independent self-contained unit, or may be used in conjunction with a remote computer system. Position data indicative of the position of a pile, and pile data indicative of characteristics of a pile may be automatically input to the PDA. When used in conjunction with the remote computer system, the PDA may be controlled remotely by the remote computer system. Alternatively, the PDA may be controlled locally by an operator, and data acquired by the PDA provided to the remote computer system for monitoring and/or storage.

18 Claims, 2 Drawing Sheets

REMOTE PILE DRIVING ANALYZER

BACKGROUND OF THE INVENTION

The present invention relates generally to the art of remote data acquisition and analysis devices, and more specifically to the art of remote data acquisition and analysis of pile driving operations. However, it will be appreciated that the system has wider application, such as in any situation in which real-time data acquisition and remote transmission is advantageously implemented.

Many of today's larger structures are fabricated with a foundation anchored to large piles that are driven into the soil. Since these piles form the dominant means of infrastructure support, it is crucial that they have known support characteristics. Such support characteristics are derived from analysis of physical characteristics obtained during the pile driving process. This process of real-time data acquisition and analysis is referred to as "dynamic pile testing."

Dynamic pile testing, such as that accomplished with the Pile Driving Analyzer®, produced by the assignee of the subject invention ("PDA"), requires an impact pile driving hammer or a relatively small drop weight (typically 1 to 1.5% of test load). Usually several piles are tested in one day at a small fraction of the cost of a single static test. The PDA investigates driving stresses and integrity, hammer performance, and bearing capacity. The results from initial production piles or test programs are used to determine the pile installation criteria, for production quality control, or to solve problems experienced in the field, such as, when blow counts (set per blow) are unusually high or low, or when pile lengths are unexpectedly long or short. The PDA transmits such data to remote engineers who may quickly isolate the problem to hammer performance, pile defects, or soil condition.

Driving Stresses are usually the most extreme event in the life of a pile. The PDA measures the compressive stress near the pile top, evaluates bending and axial alignment, calculates the tension stress which is particularly important for concrete piles, and estimates the stress at the toe/bottom of the pile in hard driving situations. Knowing these driving stresses allows the installation procedure to be adjusted, if necessary, to keep stresses within accepted limits to reduce damage to the pile.

Continuous monitoring of the pile driving process affords significant advantages. Failure to diagnose changes in conditions or characteristics may result in loss or damage to piles or equipment and unnecessary effort or errors in creation of a foundation. The areas that merit continuous, real-time evaluation include:

Integrity Evaluation

If the pile driving characteristics of a pile are unusual, the possibility of pile damage exists. Real-time measurements are the most suitable mode for detection of early deflections caused by reduced pile stiffness from damage above the pile toe.

Hammer Performance

Many pile foundation problems result from unanticipated hammer performance. Hammers delivering too much energy can damage the pile or drive the pile further than required for the established criteria, thereby increasing the costs of the foundation. Under-performing hammers increase installation time and cost, or cause the pile to refuse prematurely at high elevations resulting in failures from unacceptable settlements or low capacity. Since the hammer is also a quality control tool, routine and periodic data acquisition and testing verifies energy transfer to assure consistent performance and detect maintenance problems that may arise in larger products. Energy output of different hammers can be used to adjust the driving criteria and achieve uniform driving characteristics among all of the piles in a foundation.

Capacity

Together with the CAPWAP analysis the PDA is the only dynamic method available to reliably evaluate pile bearing capacity at the time of testing, as proven by extensive correlations. CAPWAP® is a rigorous analysis for determination of resistance distribution, dynamic response of the soil, and a simulated static load test evaluation. In sands, tests performed during driving can establish favorable pile lengths. For fine grained soils, testing during re-strike quantifies soil strength changes (set-up gains or relaxation losses); re-strike tests after sufficient wait periods of pile of different lengths can optimize pile lengths.

Other Applications

Dynamic testing is frequently performed for bridges, wharfs, and other "near-shore" structures where static testing is difficult. PDA tests are easily adapted to drilled shafts and augured CFA piles, an application very common in Asia, Europe, and South America, and also provided in the USA by PDI's sister company (GRL and Associates) at great savings over other considered alternatives. Obviously, dynamic testing performed using the PDA are far less expensive than static testing or shaft replacement. PDA testing is also used extensively for pile monitoring of offshore oil platforms with both conventional and underwater hammers.

Dynamic testing can also take other forms using equipment similar to but not necessarily identical with the PDA. In all of these types of tests, whether they are performed on piles or other structural or geotechnical elements, the common denominator is the necessity to perform a test on a sit away from laboratory or office with relatively low level skills, while a highly educated and experienced engineer has to monitor and interpret the test in real time for reasons of test validity and economy. Such tests include:

Pile Integrity testing by low strain impacts with a hand-held hammer (also referred to as Sonic Pulse Echo test or Transient Response test);

Parallel Seismic testing: a borehole is placed next to the pile; the pile is hit with a smaller hammer, the arrival time of the stress wave in the bore hole indicates the length of the pile;

Cross Hole Sonic Logging: tubes are installed in the pile and stress waves generated in one tube are measured in a neighboring one; in this way concrete quality, horizontally between tubes is verified;

Down Hole Sonic Logging: a single tube is used and wave emission and wave reception occurs in the same tube thus concrete quality in a vertical direction is verified;

Non-destructive testing: utilizes small hammer impacts on many different structural elements.

While current pile driving data acquisition (PDA) devices are effective, they nonetheless require the presence of an engineer to be on site to view and draw conclusions from the resultant data. Many times construction sites are located in relatively inaccessible locations, or in countries where a scarce number of qualified engineers are available to monitor a large number of construction sites. Unavoidable construction delays or difficulties with scheduling of tests requires that engineers spend excessive and expensive time at the construction site.

The present invention addresses these and other drawbacks of earlier data acquisition devices, and provides a system by which pile driving data may be obtained, collected and communicated to a remote operator for real time or delayed analysis. The system provides for fault tolerance to accommodate the remote data acquisition and analysis. Given the fragile nature of data communication, such robustness is especially required in developing or third-world countries.

SUMMARY OF THE INVENTION

According to the present invention there is provided a data acquisition and processing system for collecting and processing data for pile driving, the system comprising an analyzer means for acquiring and collecting pile driving data from associated sensor means. The analyzer means includes processing means for processing the pile driving data, and communication means for communicating data with a remote computer system via a communications medium.

An advantage of the present invention is the provision of a pile driving analyzer (PDA) that is capable of obtaining, processing and storing pile driving data as a field device.

Another advantage of the present invention is the provision of a pile driving analyzer (PDA) that has selectable operating modes, including stand-alone independent operation, remote control operation, and remote monitoring of collected data.

Another advantage of the present invention is the provision of a pile driving analyzer (PDA) that automatically processes position data indicative of the position of a pile and pile data indicative of characteristics of a pile.

Yet another advantage of the present invention is the provision of a pile driving analyzer (PDA) that has rugged construction suitable for use at a construction site.

Yet another advantage of the present invention is the provision of a pile driving analyzer (PDA) that is inexpensive to manufacture.

Still other advantages of the invention will become apparent to those skilled in the art upon a reading and understanding of the following detailed description, accompanying drawings and appended claims.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
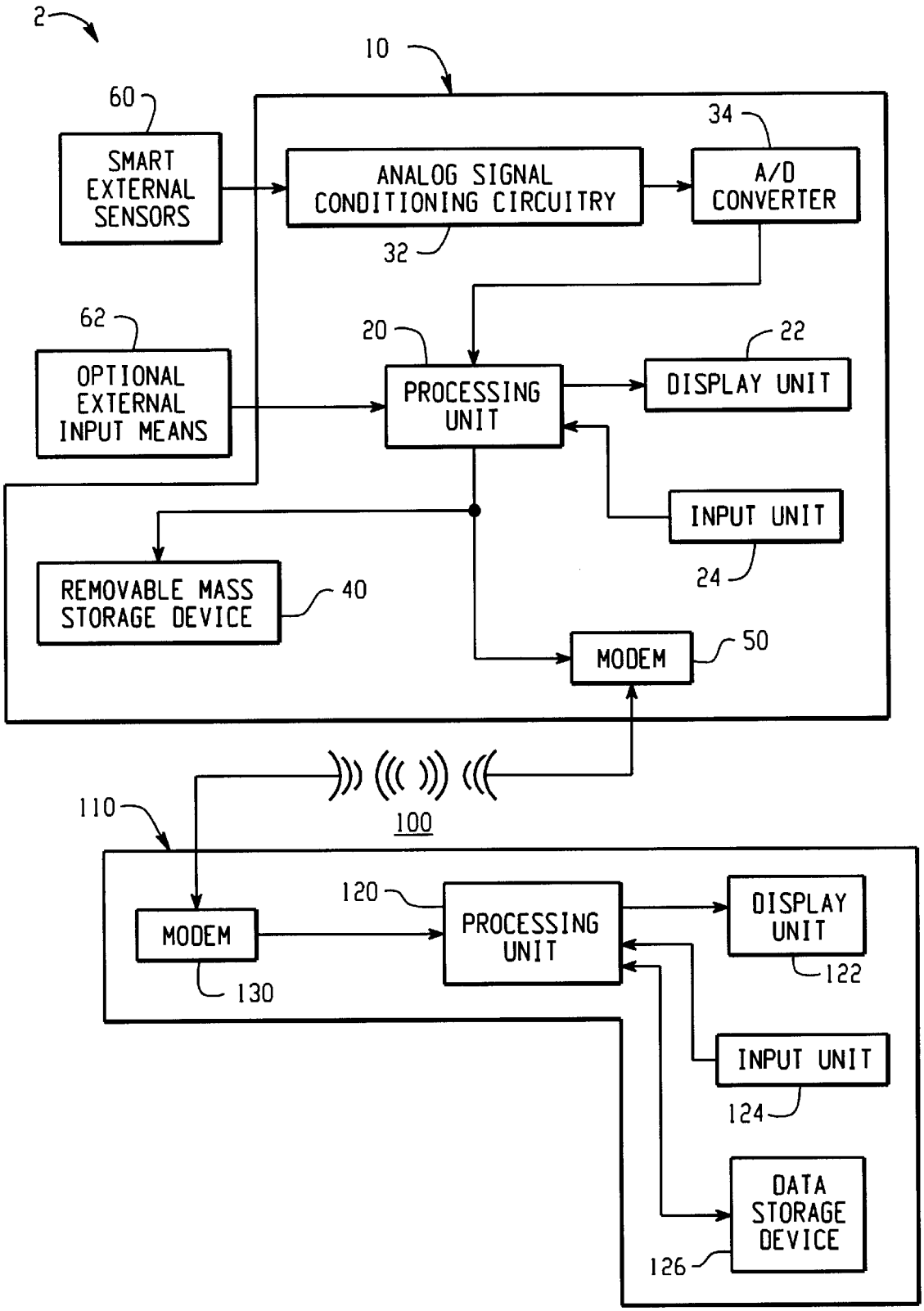
FIG. 1 is a block diagram of a data acquisition and processing system, including a pile driving analyzer, according to a preferred embodiment of the present invention.

Referring now to the drawings wherein the showings are for the purposes of illustrating a preferred embodiment of the invention only and not for purposes of limiting same, FIG. 1 shows a data acquisition and processing system 2, which is comprised of a pile driving analyzer (PDA) 10, according to a preferred embodiment of the present invention, and a remote personal computer (PC) system 110.

Pile driving analyzer (PDA) 10 is generally comprised of a processing unit 20, a display unit 22, an input unit 24, an analog signal conditioning circuit 32, an analog-to-digital (A/D) converter 34, a removable mass storage device 40 and a modem 50.

PDA 10 receives data from smart external sensors 60 and optional external input means 62. Furthermore, PDA 10 is capable of communicating with a remote PC system 110 via a communications medium 100, as will be explained in detail below.

Processing unit 20 processes all incoming signals, controls communication with remote PC system 110, controls reading/writing of data from/to mass storage device 40, displays all pertinent signals on display unit 22, controls the acquisition of data from sensors 60 and input means 62, and provides for the input and processing of data from a quality control device. In a preferred embodiment of the present invention, processing unit 20 takes the form of an automotive industry quality digital signal processor (DSP) such as will be well understood by one of ordinary skill in the art. This type of processing unit is preferred for its rugged, low power, high performance, and low cost characteristics.

Processing unit 20 is programmed to compress the data being transmitted to remote PC system 110. There are many data compression techniques that are suitably adapted to the subject system. Data compression is process of reducing the number of bits required to represent some information, usually to reduce the time or cost of storing or transmitting it. Some methods can be reversed to reconstruct the original data exactly (lossless data compression); these are used for faxes, programs and most computer data. Lossless data compression techniques are advantageously employed in the subject invention. Suitable techniques include both public domain, as well as proprietary formats, inclusive but not limited to: LZW (Lempel-Ziv-Welch), RLE (Run Length Encoding), LZS (Lempel-Ziv-Stac), V0.42 bis, or MNP (Microcom Networking Protocol). In addition, various compression techniques may be negotiated and selected by implementing a compatible negotiation protocol, such as CCP(Compression Control Protocol).

The compression techniques, such as the aforementioned, obtain high data transfer speeds between PDA 10 and remote PC system 110, while maintaining the original data quality. Accordingly, data can be received by remote PC system 110 with a minimal delay after a hammer blow has occurred.

Display unit 22 preferably takes the form of an LED or LCD display device, while input unit 24 preferably takes the form of a keyboard, mouse, trackball and/or other suitable input device.

Removable mass storage device 40 may take many forms, including a hard disk drive, a flash memory card, an SRAM type memory card, or other nonvolatile memory storage device. Mass storage device 40 stores the data received by PDA 10. When PDA 10 is operated from a remote location (e.g., via remote PC system 110), mass storage device 40 provides data backup to insure that the acquired data is not lost even if the link between PDA 10 and remote PC system 1 10 is disturbed or broken. When PDA 10 is used as an independent stand alone device, mass storage device 40 allows for fast and efficient data transfer to remote PC system 110 for additional analysis or permanent storage. It will be appreciated that mass storage device 40 may be accessed via an I/O port, such as a PCMCIA slot.

Smart external sensors 60 preferably take the form of smart transducers, such as are readily available commercially, which are strain transducers and accelerometers. In a preferred embodiment, the smart transducers store all pertinent information necessary for using the transducer.

Such information may be stored in an $E^2$-memory, flash memory, or other such inexpensive, nonvolatile memory devices capable of storing all required transducer information. When the transducers are attached to PDA 10, this information is automatically transmitted to PDA 10. This information may include a calibration constant, the date of last calibration, and the serial number for the respective transducer. It should be appreciated that the storage of transducer information and the automatic transfer of the information to PDA 10 is important as it provides for error free installation and calibration by unskilled technicians. PDA 10 will also read and record the date of last calibration stored in the transducer. If the transducer is beyond the recommended time for a calibration, PDA 10 can be programmed to notify the user. The foregoing feature insures that PDA 10 has the correct calibration constant for each transducer with no possible errors from hookup or entering the incorrect calibrations. By obtaining the date of last calibration the engineer can be automatically alerted when the transducers need to be recalibrated.

Optional external input means 62 provide PDA 10 with additional data. In this regard, optional external input means 62 may take the form of a quality control device, such as a recorder (e.g., the PILE INSTALLATION RECORDER (PIR) available from PILE DYNAMICS, INC), as well as other transducers. The information provided to PDA 10 by input means 62 preferably includes blow count, pile position/penetration, hammer impact energy, and installation angle. This information may be obtained via analog signals or in digital form via methods such as serial or network.

Additionally, PDA 10 may automatically locate the pile location by receiving information via a global positioning system ("GPS"), as will be appreciated by one of ordinary skill in the art. The current GPS is a system of 24 satellites, each of which orbits the earth about every 12 hours at a height of about 20,200 km. Four satellites are located in each of six planes inclined at about 55° to the plane of the earth's equator. When receivers receive signals simultaneously from three satellites, they are provided with sufficient data from which to calculate their latitude and longitude (with an accuracy better than 100 m for public use and 0.01 m with special corrections) and time information is provided (with an accuracy better than 1 $\mu$s) with correction GPS information sufficient for locating and identifying piles and for recording an as-built pile plan.

PDA 10 may also automatically obtain all relevant information regarding the pile (e.g., pile name/number, pile length, area, type, material, etc.) without requiring data entry by the operator. In this regard, an RF tag or a bar code attached to each pile could be used to provide the relevant information to PDA 10. Accordingly PDA 10 can obtain all pile information error free, since no user input is required. In the event of a problem with the automatic mode of retrieving sensor or pile information, PDA 10 may be programmed to bypass the automatic mode, and manually receive the information via input unit 24.

Analog signal conditioning circuits 32 preferably include standard, inexpensive electronic components. The functions of the analog signal conditioning include all required power supplies, all filtering, and all appropriate scaling. Also included for each acceleration channel is an integrator that performs the integration in real time. Such integration is suitably accomplished via a dedicated integrator, or by a digital integrator as will be understood to one of ordinary skill in the art. Signal conditioning circuits 32 also includes all circuitry required to balance all necessary channels.

A/D converter 34 digitizes all channels (analog input signals) simultaneously to avoid any time skew between channels. The analog input signals are preferably digitized at a some minimum frequency such that the original data is reproducible.

Modem 50 and modem 130 facilitate the transfer of data between PDA 10 and remote PC system 110 via a communications medium 100. Modems 50 and 130 may take the form of an external device which obtains data from a serial port, a parallel port, or a PCMCIA slot. Alternatively, modems 50 and 130 may be an integral part of PDA 10 and remote PC system 110. It should be appreciated that communications medium 110 may take the form of wires such as phone lines and Internet connections, or a wireless medium, such as cellular phone communications.

Where PDA 10 is arranged for operation in a crane, PDA 10 is preferably powered by the battery in the crane, wherein the crane battery provides a voltage of between 9 volts and 36 volts. Where PDA 10 is used in a portable, hand held mode, PDA 10 is preferably powered by batteries that are built into PDA 10.

PDA 10 further includes integration means for integrating all acceleration signals in real time. Moreover, all input signals are digitized simultaneously, thus avoiding any time skewing of the input signals. PDA 10 is also capable of distinguishing a valid trigger from false triggers. Additionally, the trigger channel can be automatically determined or mutually selected.

It is further noted that PDA 10 includes a housing that is designed to be extremely rugged for use at a construction site. Moreover, PDA 10 is preferably constructed with commonly available low cost electronic components. PDA 10 may also be equipped with the circuitry and software necessary to perform testing methods related to PDA testing such as Low Strain or Pulse Echo Pile testing, Parallel Seismic testing, Cross Hole Logging, etc. All of these require a highly educated engineer for data interpretation while field work can be done by less educated technicians.

Remote PC system 110 is generally comprised of a processing unit 120, a display unit 122, an input unit 124, a data storage device 126, and a modem 130 (described above). Remote PC system 110 preferably takes the form of a personal computer system. Accordingly, processing unit 120 is preferably a microprocessor or microcomputer. Display unit 122 typically takes the form of a video monitor or LCD display unit. Input unit 124 may take numerous forms, including a keyboard, a mouse, a trackball, and/or other input device. Data storage device 126 typically takes the form of a hard drive, floppy drive, tape drive and/or other data storage medium. It will be appreciated that processing unit 120 is programmed to expand the compressed data transmitted by PDA 10.

Processor unit 120 is programmed to analyze in real time the data being obtained from the construction site by PDA 10 ("PDAPC program"). The PDAPC program performs the appropriate signal processing and data storage. In one embodiment of the present invention, the PDAPC program has control over PDA 10 located at the construction site. In this regard, remote PC system 110 sends all appropriate instructions to PDA 10 and receives data and any other information or comments from PDA 10. Moreover, the PDAPC program may be used to only observe the pile installation data without controlling operation of PDA 10.

PDA 10 has several modes of operation. In a first mode of operation, PDA 10 operates independently of remote PC system I 10. Accordingly, processing unit 20 controls data acquisition, data processing, and data storage without any input required from remote PC system 110. Acquired data is saved to mass storage device 40. Accordingly, data can be conveniently transferred to remote PC system 110 for further data analysis or for archiving.

In another mode of operation PDA 10 is connected with remote PC system 110 via modems 50 and 130 for data communication via communications medium 100. PDA 10 is typically located at the construction site, while remote PC system 110 is at the office of the testing engineer. When configured in this manner, the testing engineer operating a PDAPC program can control operation of PDA 10. In this respect, the testing engineer can remotely set all appropriate parameters for a test, and select all calculations and analysis desired. The pile driving data obtained by PDA 10 is transmitted to remote PC system 110 via communications medium 100. To insure that no data is lost in the event that the connection between PDA 10 and remote PC system 110 is lost, PDA 10 collects all data and stores in removable mass storage device 40. It is noted that the sophisticated data compression/expansion routines allow data to be received by the testing engineer with very little time delay from the time that a blow occurs. As a result, the testing engineer can obtain all data, process this data, and store the data without traveling to the construction site. As a result, the cost of pile testing is significantly reduced. In this operating mode, there would be 2 way communication between remote PC system 110 and PDA 10. This allows the testing engineer to communicate information or comments to the field crew, and it also allows the field crew to communicate information or comments to the testing engineer. PDA 10 has the capacity to buffer all necessary data before transmitting it, in the event that the transmission suffers an interruption.

In a third mode of operation PDA 10, the field personnel would operate and control PDA 10, while at the same time being connected to the remote PC system 110 via modems 50 and 130. In this operating mode the testing engineer in the office may observe the pile driving data as it is happening without doing any storage or analysis of this data. In this case, the testing engineer would just observe the data, and notify field personnel when there is a potential problem with a particular pile.

It should be appreciated that the PDA of the present invention is unique in its ability to be operated independently and/or be operated from a remote location. The PDA also eliminates any hookup or data entry errors by automating this data acquisition process. Another unique feature of the PDA is the link to additional pile information, as well as the ability to automatically locate a pile via a system such as the global positioning system. Moreover, the PDA can be built inexpensively with standard electronic components.

Figure 2:
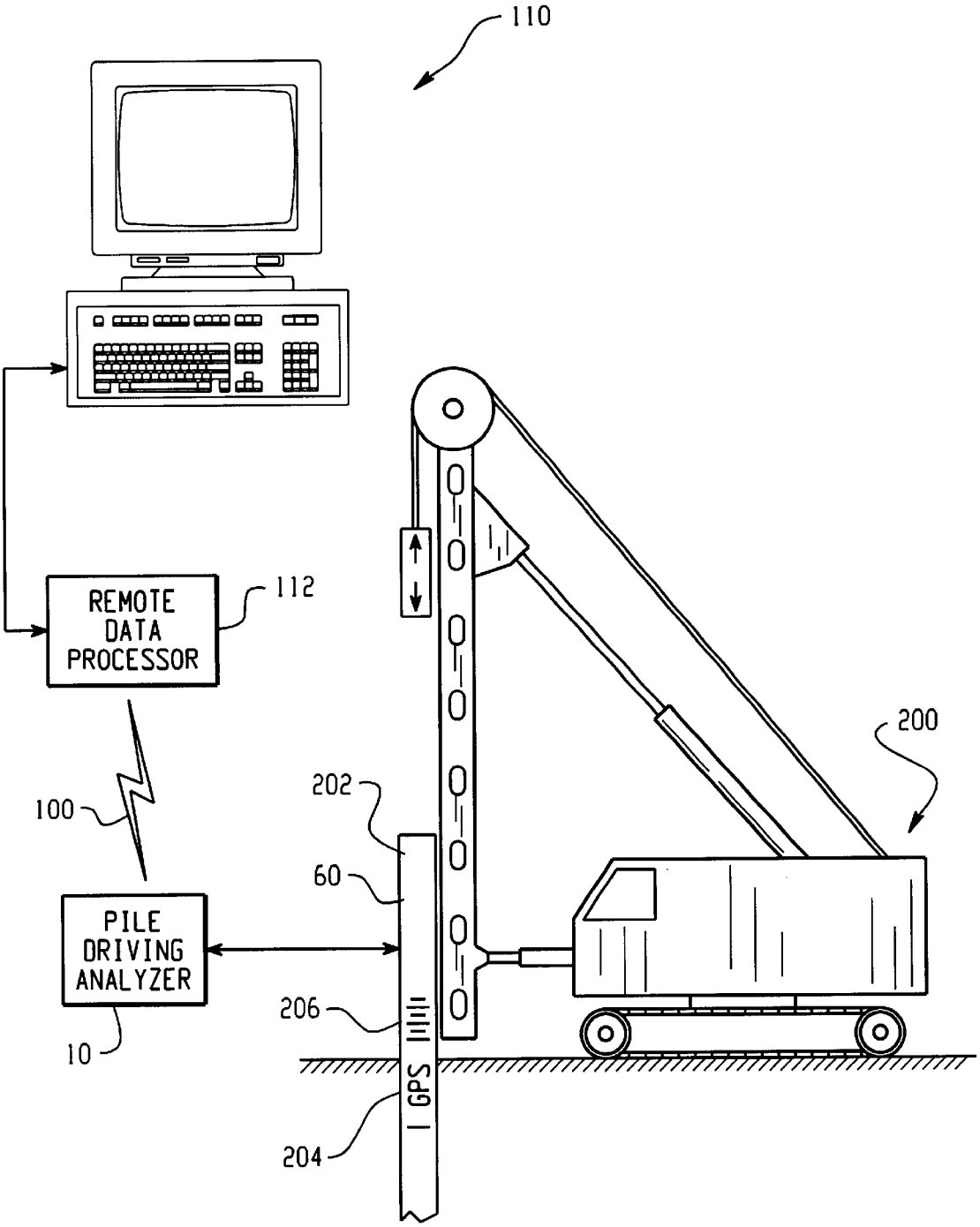
FIG. 2 is a block diagram of the remote data acquisition and analysis system of the subject invention.

Turning now to FIG. 2. disclosed is a pile driving operation undertaken by a pile driver 200. A pile 202 is shown to which smart external sensors 60 and/or optional external input means 62 are attached via a suitable attachment means. The PDA 10 receives signals from the sensors 60 and input means 62.

In the field, PDA 10 has several modes of operation. In a first mode of operation, PDA 10 operates independently of remote PC system 110 and is capable of receiving, processing and storing pile driving data from said sensors 60 and input means 62 without any input required from a remote computer.

In another mode of operation, PDA 10 is connected with a remote data processor 112. Remote data processor 112 may take many forms, including a file server or may comprise a portion of remote PC system 110. Communications between PDA 10 and remote data processor 112 occur via communication medium 100. As illustrated in FIG. 2, PDA 10 is typically located at the construction site, while remote PC system 110 is at the office of the testing engineer. When configured in this manner, the testing engineer operating a PDAPC program can control operation of PDA 10. In this respect, the testing engineer can remotely set all appropriate parameters for a test, and select all calculations and analysis desired.

The pile driving data obtained by PDA 10 is transmitted to remote PC system 110 via communications medium 100. To insure that no data is lost in the event that the connection between PDA 10 and remote data processor 112 is lost, PDA 10 collects all data and stores in a manner previously discussed. Due to the sophisticated data compression/expansion routines, data may received by the testing engineer with very little time delay from the time that a blow occurs. As a result, the testing engineer can obtain all data, process this data, and store the data without traveling to the construction site. As a result, the cost of pile testing is significantly reduced.

In this operating mode, there would be 2 way communication between remote PC system 110 and PDA 10. This allows the testing engineer to communicate information or comments to the field crew, and it also allows the field crew to communicate information or comments to the testing engineer. PDA 10 has the capacity to buffer all necessary data before transmitting it, in the event that the transmission suffers an interruption.

In a third mode of operation PDA 10, the field personnel operate and control PDA 10, while at the same time being connected to the remote data processor 112 via the communication medium 100. In this operating mode the testing engineer in the office may observe the pile driving data as it is happening without doing any storage or analysis of this data. In this case, the testing engineer would just observe the data, and notify field personnel when there is a potential problem with a particular pile. The test engineer would, however, be able to subject the data to additional analysis as CAPWAP.

Also illustrated in FIG. 2 are several items associated with the pile 202 as utilized in the embodiment of the current invention. A global positioning system 204 illustrated generally as 204 is ideally associated with a pile to allow for precise positioning information thereof to be obtained. Also illustrated are indicia, such as bar coding or UPC coding 206, which is associated with the pile to allow for associating characteristics therewith.

It will be appreciated from the foregoing that the subject invention has application in other construction areas, not only limited to pile driving operations. Remote data acquisition, coupled with GPS positioning and/or UPC encoding, or the like, is suitably used in many facets of construction. For example, use of such a system can be used in other construction areas, such as I-beam placement, trusses, or virtually any load bearing member which is advantageously monitored during the construction process. As with the pile driving analysis of the preferred embodiment, such a system allows for precise monitoring of the construction operation, together with efficient utilization of a technician who needs not be on site.

The invention has been described with reference to a preferred embodiment. Obviously, modifications and alterations will occur to others upon a reading and understanding of this specification. It is intended that all such modifications and alterations be included insofar as they come within the scope of the appended claims or the equivalents thereof.

Having thus described the invention, it is now claimed:

1. A data acquisition and processing system for collecting and processing data for pile driving, the system comprising:

data acquisition means for acquiring pile driving data from an associated sensor means disposed in relatively close proximity thereto, the pile driving data including at least one of a plurality of measurable physical characteristics associated with a pile driving operation;

a non-volatile local data store, disposed in relatively close proximity to the data acquisition means, for selectively storing the pile driving data;

processing means for processing the pile driving data into a format adapted for analysis thereof;

means for selectively removing data from the non-volatile local data store to facilitate analysis thereof;

encoding means adapted for selectively encoding the pile driving data into encoded pile driving data to facilitate at least one of storage/retrieval and remote communication thereof; and remote data communication means adapted for selectively initiating a contact with at least one associated remote data station, the remote data communication means including:

data transmission means adapted for selectively communicating encoded pile driving data with the at least one associated remote data station; and data receiving means adapted for communicating at least one of operating instructions and control data received from the at least one associated remote data station.

2. The data acquisition and processing system for collecting and processing data for pile driving of claim 1 further comprising the at least one associated remote data station including:

a data station receiving means adapted for selectively communicating encoded pile driving data with the data transmission means;

a data station data transmission means adapted for communicating at least one of operating instructions and control data with the data receiving means; and means for selectively decoding pile driving data received therein so as to displayed in a humanly-viewable format.

3. The data acquisition and processing system for collecting and processing data for pile driving of claim 1 further comprising analyzer means for unsupervised obtaining of pile driving data from associated, external transducers.

4. The data acquisition and processing system for collecting and processing data for pile driving of claim 1 further comprising means for selectively removing the non-volatile, local data store so as to be adapted for use in an associated, secondary data processing system.

5. The data acquisition and processing system for collecting and processing data for pile driving of claim 1 wherein said pile driving data includes at least one of blow count data, pile position data, pile penetration data, energy data, and installation angle.

6. The data acquisition and processing system for collecting and processing data for pile driving of claim 5 further comprising analyzer means including data input means for automatically obtaining position data indicative of the position of a pile that is to be installed.

7. The data acquisition and processing system for collecting and processing data for pile driving of claim 6, wherein said data input means receives the pile position data from a global positioning system (GPS).

8. The data acquisition and processing system for collecting and processing data for pile driving of claim 1 further comprising a means for acquiring pile identification data identifying each particular pile from which pile driving data is acquired, and means for associating pile driving data therewith.

9. The data acquisition and processing system for collecting and processing data for pile driving of claim 8 wherein said pile identification data includes at least one of: pile name/number, length, area, type, and material.

10. The data acquisition and processing system for collecting and processing data for pile driving of claim 1 further comprising testing means for automatically testing external sensors and providing data representative of potential problems.

11. The data acquisition and processing system for collecting and processing data for pile driving of claim 1 further comprising a removable data storage device for storing data collected by said data acquisition means.

12. The data acquisition and processing system for collecting and processing data for pile driving of claim 1 further comprising data compression means for compressing data acquired by said data acquisition means.

13. The data acquisition and processing system for collecting and processing data for pile driving of claim 3 wherein said analyzer means is operable by field personnel while simultaneously allowing data acquired by said analyzer means to be viewed by personnel at a remote location, said data being transmitted by the communication means to the remote location via the data communications medium.

14. The data acquisition and processing system for collecting and processing data for pile driving of claim 1 further comprising sensor means including at least one of strain transducers and accelerometers for acquiring the pile driving data.

15. A method of data acquisition and processing for collecting and processing data for pile driving, the system comprising the steps of:

acquiring pile driving data from an associated sensor means disposed in relatively close proximity thereto, the pile driving data associated with a pile driving operation;

selectively storing the pile driving data in an associated, non-volatile local data store;

selectively removing data from the non-volatile local date store to facilitate analysis thereof;

selectively encoding the pile driving data into encoded pile driving data to facilitate at least one of storage/retrieval and remote communication thereof;

processing the pile driving data to facilitate analysis thereof;

initiating a contact with at least one associated remote data station;

selectively communicating encoded pile driving data with the at least one associated remote data station; and communicating at least one of operating instructions and control data received from the at least one associated remote data station.

16. The method of data acquisition and processing system for collecting and processing data for pile driving of claim 1 further comprising the steps including:

selectively communicating, at least one associated remote data station, encoded pile driving data with the data transmission means;

selectively communicating of via at least one associated remote data station, at least one of operating instructions and control data with the data receiving means; and means for selectively decoding pile driving data received at least one associated remote data station, so as to displayed in a humanly-viewable format.

17. A remote data acquisition and monitoring system comprising:

data acquisition means for acquiring construction data from an associated sensor means disposed in relatively close proximity thereto, the construction data including at least one of a plurality of measurable physical characteristics associated with a construction operation;

a non-volatile local data store, disposed in relatively close proximity to the data acquisition means, for selectively storing the construction data;

processing means for processing the construction data into a format adapted for analysis thereof;

means for selectively removing data from the non-volatile local data store to facilitate analysis thereof;

encoding means adapted for selectively encoding the construction data into encoded construction data to facilitate at least one of storage/retrieval and remote communication thereof;

at least one associated remote data station, each remote data communication means including, data transmission means adapted for selectively communicating encoded construction data with the at least one associated remote data station, and data receiving means adapted for communicating at least one of operating instructions and control data received from the at least one associated remote data station; and at least one associated remote data station including, a data station data receiving means adapted for selectively communicating encoded construction data with the data transmission means, a data station data transmission means adapted for communicating at least one of operating instructions and control data with the data receiving means; and means for selectively decoding construction data received therein so as to be displayed in a human-viewable format.

18. The remote data acquisition and monitoring system of claim 17 further comprising a sensor array for generating the construction data, the sensor array including means for acquiring bar-coded information relative to identification of construction materials and position information relative to a physical location of the construction materials as set forth by reference to a global positioning system.

* * * * *